US011151945B2

(12) United States Patent
Yuan et al.

(10) Patent No.: US 11,151,945 B2
(45) Date of Patent: Oct. 19, 2021

(54) ORGANIC LIGHT EMITTING DIODE DISPLAY DEVICE AND CONTROL METHOD THEREOF

(71) Applicants: Hefei BOE Joint Technology Co., Ltd., Hefei (CN); BOE TECHNOLOGY GROUP CO., LTD., Beijing (CN)

(72) Inventors: Zhidong Yuan, Beijing (CN); Can Yuan, Beijing (CN); Yongqian Li, Beijing (CN)

(73) Assignees: Hefei BOE Joint Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/639,052

(22) PCT Filed: Jul. 18, 2019

(86) PCT No.: PCT/CN2019/096538

§ 371 (c)(1),
(2) Date: Feb. 13, 2020

(87) PCT Pub. No.: WO2020/186668

PCT Pub. Date: Sep. 24, 2020

(65) Prior Publication Data

US 2021/0134230 A1 May 6, 2021

(30) Foreign Application Priority Data

Mar. 15, 2019 (CN) ..... 201910198968.2

(51) Int. Cl.
*G09G 3/3275* (2016.01)

(52) U.S. Cl.
CPC ... *G09G 3/3275* (2013.01); *G09G 2300/0819* (2013.01); *G09G 2320/0295* (2013.01)

(58) Field of Classification Search
None
See application file for complete search history.

(56) References Cited

U.S. PATENT DOCUMENTS 10,068,520 B2 9/2018 Xiang et al.
10,460,658 B2 10/2019 Xiang et al.
2017/0132977 A1* 5/2017 Kim ..... G09G 3/3266

FOREIGN PATENT DOCUMENTS

CN 103003864 A 3/2013
CN 105321456 A 2/2016
(Continued)

OTHER PUBLICATIONS

First Office Action to Chinese Application No. 201910198968.2, dated Jul. 6, 2020 with English translation (13p).
(Continued)

*Primary Examiner* — Christopher J Kohlman
(74) *Attorney, Agent, or Firm* — Arch & Lake LLP

(57) ABSTRACT

The present disclosure provides an organic light emitting diode (OLED) display device and control method thereof. The OLED display device includes: a plurality of subpixels that are arranged in an array having a plurality of rows and a plurality of columns, wherein at least one of the subpixels comprises a control transistor, a light emitting element, and a drive transistor for driving the light emitting element; a plurality of detection lines, wherein at least one of the detection lines is electrically connected with the control transistors of subpixels in a same column, for detecting an electrical property of the drive transistors of subpixels in the same column through respective control transistors; and a plurality of group detection control lines, wherein at least one of the group detection control lines is electrically connected with control transistors of a subpixel group, the subpixel group comprising subpixels in a first row and subpixels in a second row.

20 Claims, 4 Drawing Sheets

(56) References Cited

FOREIGN PATENT DOCUMENTS

| | | | |
|---|---|---|---|
| CN | 105679237 | A | 6/2016 |
| CN | 105741782 | A | 7/2016 |
| CN | 106531084 | A | 3/2017 |
| CN | 106548752 | A | 3/2017 |
| CN | 106935185 | A | 7/2017 |
| CN | 107799060 | A | 3/2018 |
| CN | 107980159 | A | 5/2018 |
| CN | 108417178 | A | 8/2018 |
| CN | 108766360 | A | 11/2018 |
| CN | 108806567 | A | 11/2018 |
| CN | 109215584 | A | 1/2019 |
| CN | 109308877 | A | 2/2019 |
| CN | 109742134 | A | 5/2019 |
| KR | 20160083613 | A | 7/2016 |
| WO | 2018175338 | A1 | 9/2018 |

OTHER PUBLICATIONS

The International Search Report Issued in Application No. PCT/CN2019/096538 dated Dec. 11, 2019, (13p).

* cited by examiner

ORGANIC LIGHT EMITTING DIODE DISPLAY DEVICE AND CONTROL METHOD THEREOF

CROSS-REFERENCE TO RELATED APPLICATIONS

This application is the U.S. national phase of PCT Patent Application No. PCT/CN2019/096538 filed on Jul. 18, 2019, which claims the priority of Chinese Patent Application No. 201910198968.2, filed on Mar. 15, 2019, the entire content of both of which is incorporated herein by reference in their entirety for all purposes.

TECHNICAL FIELD

The present disclosure relates to the technical field of display technology, and particularly relates to an organic light emitting diode (OLED) display device and control method thereof.

BACKGROUND

An existing active matrix organic light emitting diode (AMOLED) display device comprises drive transistors used for driving the organic light emitting diode (OLED). In accordance with the increase of driving time, the threshold voltage Vth and the mobility K of the drive transistor will shift, and accordingly causing luminance non-uniformities. Therefore, it is required to compensate the drive transistor in the working process of the existing OLED display device.

SUMMARY

The present disclosure provides an OLED display device and control method thereof.

According to a first aspect, there is provided an organic light emitting diode (OLED) display device, comprising: a plurality of subpixels that are arranged in an array having a plurality of rows and a plurality of columns, wherein at least one of the subpixels comprises a control transistor, a light emitting element, and a drive transistor for driving the light emitting element; a plurality of detection lines, wherein at least one of the detection lines is electrically connected with the control transistors of subpixels in a same column, for detecting an electrical property of the drive transistors of subpixels in the same column through respective control transistors; and a plurality of group detection control lines, wherein at least one of the group detection control lines is electrically connected with control transistors of a subpixel group, the subpixel group comprising subpixels in a first row and subpixels in a second row.

According to a second aspect, there is provided a method for driving an organic light emitting diode (OLED) display device, wherein the OLED display device comprises: a plurality of subpixels that are arranged in an array having a plurality of rows and a plurality of columns, wherein at least one of the subpixels comprises a control transistor, a light emitting element, and a drive transistor for driving the light emitting element; a plurality of detection lines, wherein at least one of the detection lines is electrically connected with the control transistors of subpixels in a same column, for detecting an electrical property of the drive transistors of subpixels in the same column through respective control transistors; and a plurality of group detection control lines, wherein at least one of the group detection control lines is electrically connected with control transistors of a subpixel group, the subpixel group comprising subpixels in a first row and subpixels in a second row; wherein the method comprises: performing detection for subpixels in a row; wherein performing detection for the subpixels in the row comprises: providing a conduction signal to a corresponding group detection control line; and providing OFF signals to other group detection control lines, so that the detection lines detect the drive transistors of the subpixels in the row.

BRIEF DESCIRPTION OF THE DRAWINGS

The accompanying drawings, which are incorporated in and constitute a part of this specification, illustrate examples consistent with the present disclosure and, together with the description, serve to explain the principles of the present disclosure.

Figure 2:
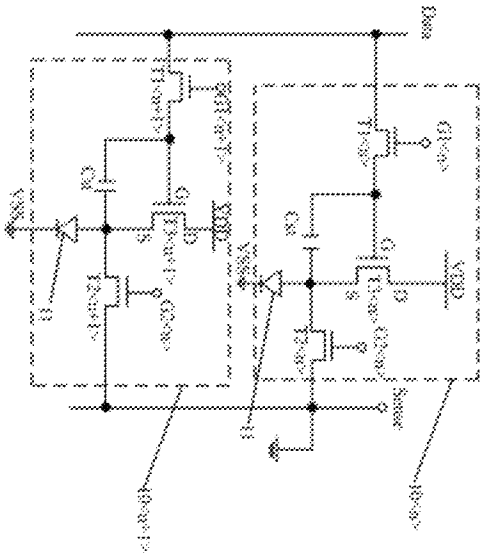
FIG. 2 is a schematic circuit configuration of an OLED display device according to one example of the present disclosure.
Figure 5A:
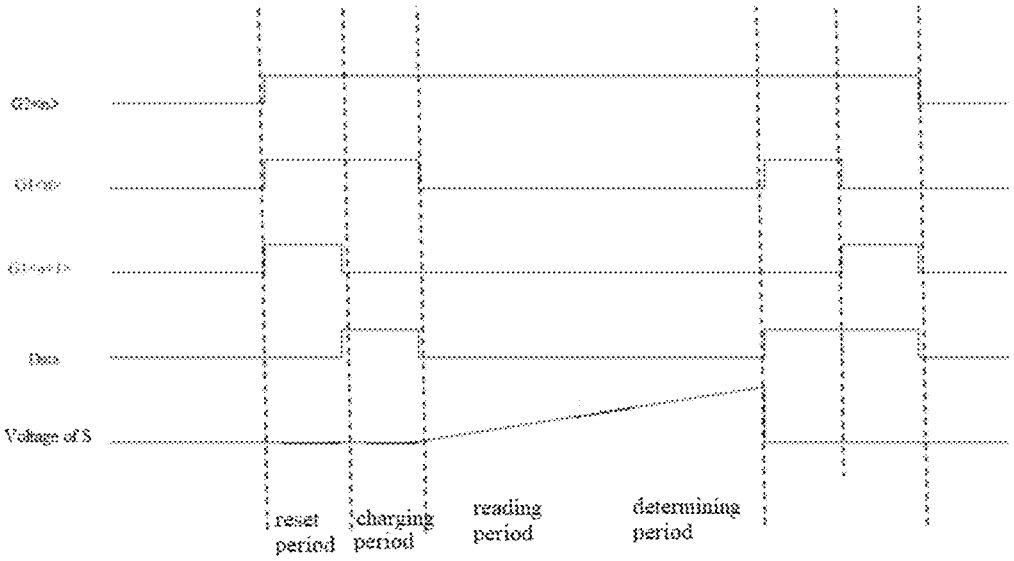

FIG. 5*a* is a time chart for detecting a mobility of the OLED display device illustrated in FIG. 2.

Figure 5B:
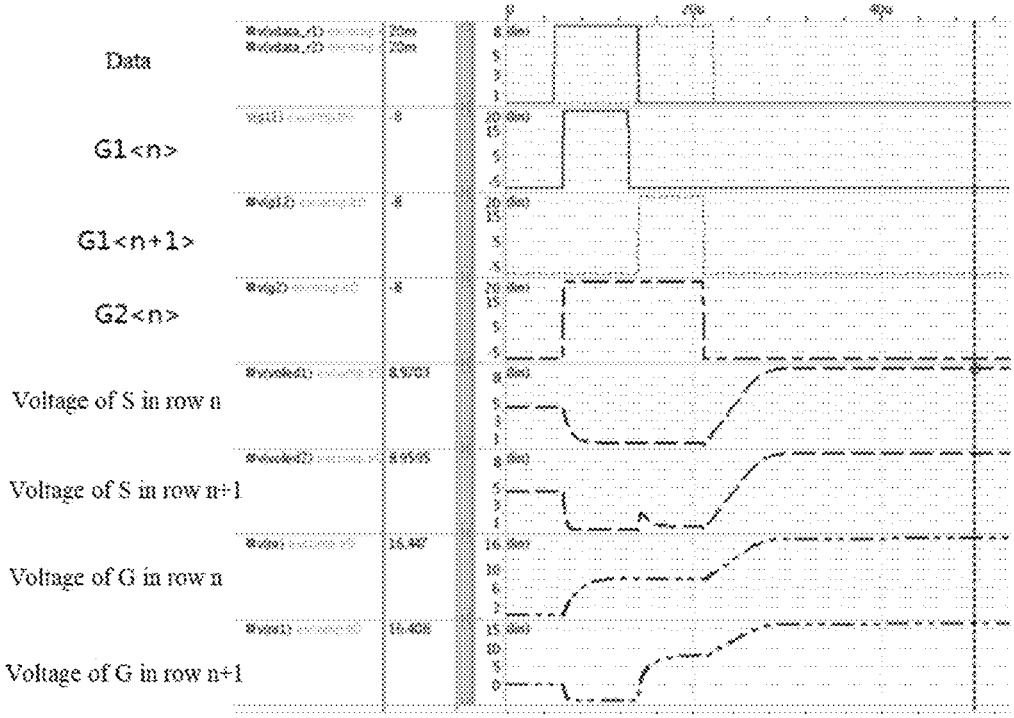

FIG. 5*b* is a simulation plot of detecting the mobility of the OLED display device illustrated in FIG. 2.

Figure 6:
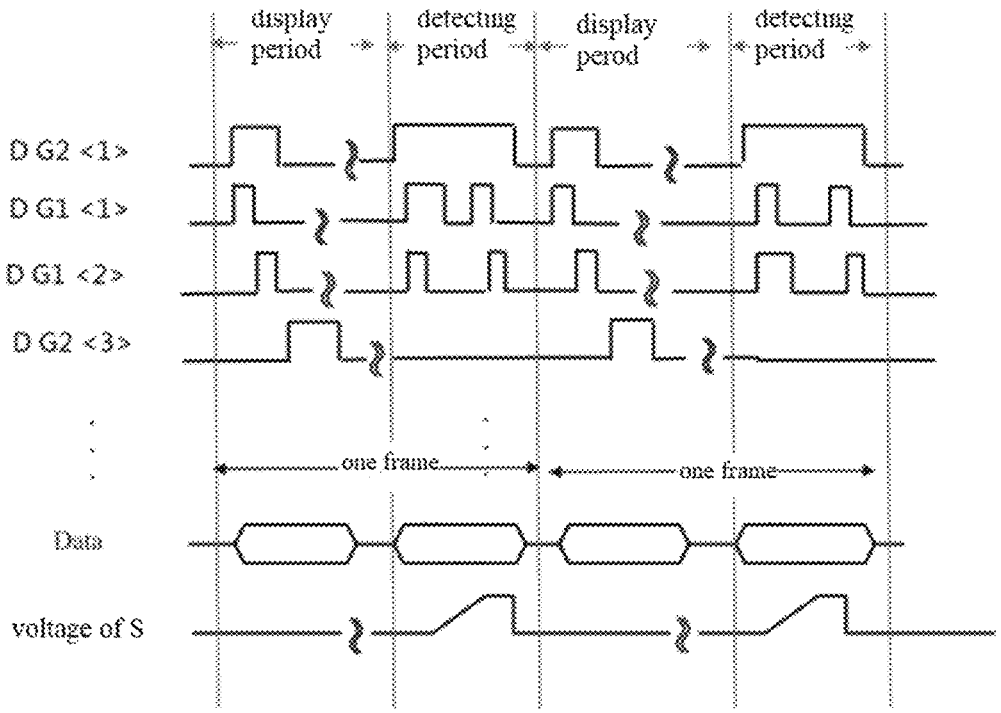

FIG. 6 is a time chart of the OLED display device illustrated in FIG. 2.

DETAILED DESCRIPTION

Reference will now be made in detail to examples of which are illustrated in the accompanying drawings. The following description refers to the accompanying drawings in which the same numbers in different drawings represent the same or similar elements unless otherwise represented. The implementations set forth in the following description of examples do not represent all implementations consistent with the disclosure. Instead, they are merely examples of apparatuses and methods consistent with aspects related to the disclosure.

The terminology used in the present disclosure is for the purpose of describing exemplary examples only and is not intended to limit the present disclosure. As used in the present disclosure and the claims, the singular forms "a" "an" and "the" are intended to include the plural forms as well, unless the context clearly indicates otherwise. It shall also be understood that the terms "or" and "and/or" as used herein are intended to signify and include any or all possible combination of one or more associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one example," "an example," "another example," or the like in the singular or plural means that one or more particular features, structures, or characteristics described in connection with an example is included in at least one example of the present disclosure. Thus, the appearances of the phrases "in one example" or "in an example," "in another example," or the like in the singular or plural in various places throughout this specification are not necessarily all referring to the same example. Furthermore, the particular features, structures, or characteristics in one or more examples may include combined in any suitable manner.

Figure 1:
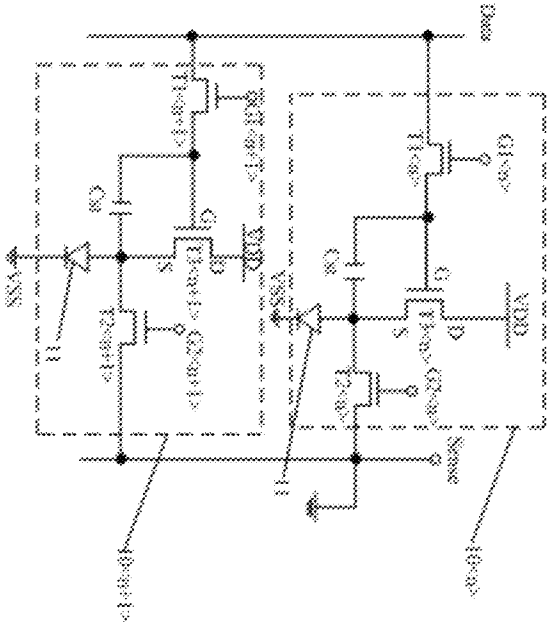
FIG. 1 is a schematic circuit configuration of an OLED display device.

Specifically, as illustrated in FIG. 1, in the OLED display device, subpixels 10 of each column connect with a detection line Sense that is used for detecting subpixels, and subpixels of each row connect with a control line G2 that is used for controlling the detection line to perform the detection.

The existing OLED display device includes many rows of subpixels, and the number of control lines is the same as the number of the rows. Accordingly, the existing OLED display device has a large number of control lines, and therefore requiring larger layout space and hardly implementing thin frame.

As illustrated in FIG. 1, 10 refers to subpixel, G1 refers to gate line, Data refers to data line, G2 refers to control line, Sense refers to detection line, T1 refers to switch transistor, T2 refers to control transistor, T3 refers to drive transistor, G refers to gate of the drive transistor, D refers to a first electrode of the drive transistor, S refers to a second electrode of the drive transistor, 11 refers to light emitting element, Cst refers to storage capacity, VDD refers to a first voltage terminal, and VSS refers to a second voltage terminal.

As illustrated in FIGS. 2-6, one example of the present disclosure provides an OLED display device comprising: multiple subpixels 10 that are arranged in an array, multiple gate lines G1, multiple data lines Data, multiple control lines G2, and multiple detection lines Sense. Each subpixel 10 comprises: a switching transistor T1, a drive transistor T3, a control transistor T2, a light emitting element 11, and a drive transistor T3 that is used for driving the light emitting element 11.

And gates of the switching transistors of the subpixel in each row of the array are connected with a gate line, first electrodes of the switching transistors of the subpixels in each column are connected with a data line Data, first electrodes of the control transistors of the subpixels in each row are connected with a detection line Sense, and the detection line is used for detecting the drive transistors of the subpixels by the control transistors. The subpixels are divided into multiple groups based on rows. Each group of subpixels or each subpixel group comprise at least two rows of the subpixels 10, and gates of the control transistors T2 of all the subpixels 10 in each group are connected with one control line G2 or a group detection control line G2.

That is, the gate line G1 may control the conduction of the switching transistor T1 for each subpixel 10. The signal of the date line Data is used for controlling, by the switching transistor T1, the conduction of the drive transistor T3, and accordingly, the light emitting element 11 receives a signal from the first voltage terminal VDD. The control line G2 may control the conduction of the control transistor T2. Then the detection line Sense detects the subpixel 10 by reading, through the control transistor T2, the detection signal of the subpixel 10.

Each gate line G1 may concurrently control the switching transistors T1 of the subpixels in a row. As illustrated in FIG. 2, the gate line G1<*n*> may concurrently control the switching transistors T1<*n*> of the subpixels in row n, the gate line G1<*n*+1> may concurrently control the switching transistors T1<*n*+1> of the subpixels in row n+1, and that is, the data line Data of subpixels in one row may concurrently provide signals to subpixels in this row. Each gate line G2 may concurrently connect a group of subpixels 10 or a subpixel group that may be in multiple rows. As illustrated in FIG. 2, the gate line G2<*n*> may concurrently control the control transistors T2<*n*> of subpixels in row n and the control transistors T2<*n*+1> of subpixels in row n+1, and that is, a control line G2 may concurrently control the detection, by the detection line Sense, of all subpixels 10 in one group.

One example of the present disclosure provides an OLED display device, where a control line G2 are connected with a group of subpixels. Each group of subpixels comprises multiple rows of subpixels 10, that is, a control line G2 may concurrently control multiple rows of subpixels. Therefore, compared with the existing arrangement that subpixels in each row are connected with a gate line G2, the OLED display device decreases the amount of gate lines G2, saves layout space, implements thin frame of the OLED display device, facilitate mass production, improves yield and optimizes lifetime.

According to an example of the present disclosure, there is provided an OLED display device, including: a plurality of subpixels 10 that are arranged in an array having a plurality of rows and a plurality of columns, where each one of the subpixels includes a control transistor T2, a light emitting element 11, and a drive transistor T3 for driving the light emitting element; a plurality of detection lines Sense, where each one of the detection lines is electrically connected with the control transistors of subpixels in a same column, for detecting an electrical property of the drive transistors of subpixels in the same column through respective control transistors; and a plurality of group detection control lines G2, where each one of the group detection control lines is electrically connected with control transistors of a subpixel group, the subpixel group comprising subpixels in a first row (e.g. row n) and subpixels in a second row (e.g. row n+1). The first row and the second row may be adjacent rows. In an example, the subpixel group may further include subpixels in a third row, and the group detection control line is further electrically connected with control transistors of the subpixels in the third row. The first, second and third rows may be three adjacent rows.

In the OLED display device, each subpixel 10 further includes a switching transistor T1 having a gate electrically connected with a gate line G1, a first electrode electrically connected with a data line Data, and a second electrode electrically connected to the drive transistor of the subpixel. The subpixels in a same row are electrically connected with a gate line; and the subpixels in a same column are electrically connected with a data line.

Each drive transistor T3 has a gate electrically connected with the second electrode of the switching transistor T1, a first electrode electrically connected with a first voltage terminal VDD, and a second electrode electrically connected with the light emitting element 11.

Each control transistor T2 of a subpixel has a gate electrically connected with a group detection control line corresponding to the subpixel group to which the subpixel belongs, a first electrode electrically connected with the detection line Sense of a corresponding column, and a second electrode electrically connected with the drive transistor T3 and the light emitting element 11 of the corresponding subpixel.

Each subpixel may further include a storage capacitor Cst having a first terminal connected with the second electrode of the switching transistor T1, and a second terminal connected with the second electrode of the drive transistor T3.

One example of the present disclosure provides a method for driving an OLED display device. The method comprises detecting each subpixel in a row, and wherein the step of detecting each subpixel in a row comprises: providing a conduction signal to a control line that is corresponding to the subpixels that belong to the same group of the detected subpixels, and providing shutdown signal to other control lines, so that the detection line detects the drive transistors of the subpixels in the row.

As illustrated in FIG. 2, if the subpixels 10<*n*> in the row n are the subpixels to be detected, then providing a conduction signal to the control line G2<*n*> that is corresponding to the subpixels in row n, and providing a conduction signal to the gate line G2<*n*> that is corresponding to the subpixels in row n. As a result, the detection line Sense only detects the drive transistors T3<*n*> of the subpixels in row n.

Additionally, because the control line G2, that receives the conduction signal, is connected with other subpixels 10 that are in the same group with subpixels in the row, the control line G2 may control, but not detect at the same time, the detection for the transistors of subpixels in other rows that are in the same group with the subpixels in this row.

As illustrated in FIGS. 2-6, one example of the present disclosure provides an OLED display device comprising multiple subpixels 10 that are distributed in an array, multiple gate lines G1, multiple data lines Data, multiple control lines G2, and multiple detection lines Sense. Each subpixel comprises a switching transistor T1, a drive transistor T3, a control transistor T2, a light emitting element 11, and the drive transistor T3 is used for driving the light emitting element 11.

Wherein gates of the switching transistors T1 of the subpixels in each row of the array are connected with a gate line G1, first electrodes of the switching transistors T1 of the subpixels 10 in each column are connected with a data line Data, first electrodes of the control transistors T2 of the subpixels 10 in each row are connected with a detection line Sense, and the detection line Sense is used for detecting the drive transistors T3 of the subpixels 10 by the control transistors T2; furthermore, the subpixels 10 are divided into multiple groups based on rows, each group of subpixels 10 comprise at least two rows of the subpixels 10, and gates of the control transistors T2 of all the subpixels 10 in each group are connected with a control line G2.

That is, the gate line G1 may control the conduction of the switching transistor T1 for each subpixel 10. The signal of the date line Data is used for controlling, by the switching transistor T1, the conduction of the drive transistor T3, and accordingly, the light emitting element 11 receives a signal from the first voltage terminal VDD. The control line G2 may control the conduction of the control transistor T2. Then the detection line Sense detects the subpixel 10 by reading, through the control transistor T2, the detection signal of the subpixel 10.

Each gate line G1 may concurrently control the switching transistors T1 of the subpixels in a row. As illustrated in FIG. 2, the gate line G1<*n*> may concurrently control the switching transistors T1<*n*> of the subpixels in row n, the gate line G1<*n*+1> may concurrently control the switching transistors T1<*n*+1> of the subpixels in row n+1, and that is, the data line Data of subpixels 10 in one row may concurrently provide signals to subpixels in this row. Each gate line G2 may concurrently connect a group of subpixels 10 that may be in multiple rows. As illustrated in FIG. 2, the gate line G2<*n*> may concurrently control the control transistors T2<*n*> of subpixels in row n and the control transistors T2<*n*+1> of subpixels in row n+1, and that is, a control line G2 may concurrently control the detection, by the detection line Sense, of all subpixels in one group.

One example of the present disclosure provides an OLED display device, wherein a control line G2 are connected with a group of subpixels 10. Each group of subpixels comprises multiple rows of subpixels 10, that is, a control line G2 may concurrently control multiple rows of subpixels 10. Therefore, compared with the existing arrangement that subpixels 10 in each row are connected with a gate line G2, the OLED display device decreases the amount of gate lines G2, saves layout space, implements thin frame of the OLED display device, facilitate mass production, improves yield and optimizes lifetime.

In an example, each group of subpixels comprises two rows of the subpixels 10 (as illustrated in FIG. 2, subpixel 10<*n*> in row n and subpixel 10<*n*+1> in row n+1). And wherein a control line G2 is connected with subpixels 10 in two adjacent rows, or a control line G2 may concurrently control the detection for subpixels in two adjacent rows. Such connections may simplify the fabrication of the OLED display device, and improve the fabricating efficiency.

Figure 3:
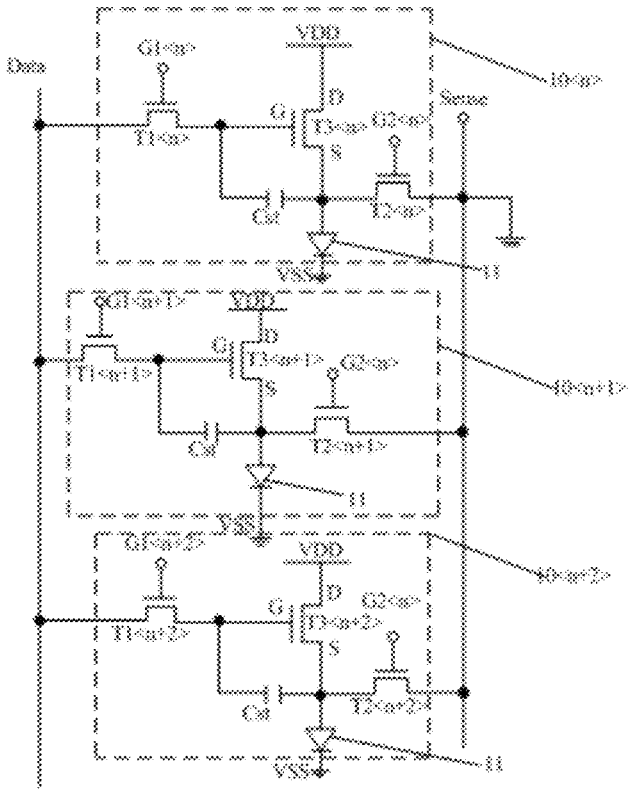
FIG. 3 is a schematic circuit configuration of an OLED display device according to another example of the present disclosure.

In an example, each group of subpixels 10 may comprise subpixels in three adjacent rows (as illustrated in FIG. 3, subpixel 10<*n*> in row n, subpixel 10<*n*+1> in row n+1, and subpixel 10<*n*+2> in row n+2).

Specifically, a control line G2 is connected with subpixels 10 in three adjacent rows, or a control line G2 may concurrently control the detection for the subpixels 10 in three adjacent rows. Such connections may further decrease the number of control lines G2, and thereby decreasing layout space, and easily implementing thin frame of the OLED display device.

In an example, in each subpixel 10, the drive transistor T3 is serially connected with the light emitting element 11, and the second electrode of the control transistor T2 is connected between the drive transistor and the light emitting element.

Specifically, the gate G of the drive transistor T3 is connected with the second electrode of the switching transistor T1, the first electrode D is connected with the first voltage terminal VDD, and the second electrode is connected with the light emitting element 11. Each subpixel further comprises a storage capacity Cst, one terminal of which is connected with the second electrode of the switching transistor T1, and the second electrode that is connected with the second electrode S of the drive transistor T3.

Specifically, the first voltage terminal is for providing working voltage VDD, and the light emitting element 11 is used for connecting with a second voltage terminal VSS.

One example of the present disclosure provides a method for driving an OLED display device stated above. The method comprises the following steps: detecting or performing detection for each subpixel 10 in a row. The step of performing detection for each subpixel 10 in the row comprises: providing a conduction signal or an ON signal to a control line or a group detection control line G2 that is corresponding to the subpixel group to which the subpixels in the row belong, and providing shutdown signals or OFF signals to other control lines G2, so that the detection lines Sense detect the drive transistors T3 of the pixels 10 in the row. The terms "ON signal" and "conduction signal" may be used interchangeably, and similarly, the terms "OFF signal" and "shutdown signal" may be used interchangeably in the disclosure.

For example, as illustrated in FIG. 2, if the subpixels 10<*n*> in row n are the subpixels to be detected, a conduction signal is provided to the control line G2<*n*> that is corresponding to the subpixels 10<*n*> in row n, and at the same time a conduction signal is provided to the gate line G1<*n*> that is corresponding to the subpixels in row n, and accordingly the detection lines Sense only detect the drive transistors T3<*n*> of the subpixels 10<*n*> in row n.

Additionally, the control line G2 that receives the conduction signal is concurrently connected with subpixels 10 that are in other rows that are in the same subpixel group as the subpixels 10 in this row. Consequently, this control line G2 may control, but not detect concurrently, the detection of the transistors of subpixels that are in other rows in the same group as the subpixels 10 in this row.

Moreover, the step of performing detection for each subpixel in a row comprises a detecting threshold voltage Vth for each subpixel in the row. And the step of detecting the threshold voltage Vth for each subpixel in the row comprises:

S11: providing a conduction signal to a gate line G1 corresponding to the subpixels 10 in this row; providing shutdown signals to gate lines G1 corresponding to subpixels in other rows; providing a first preset signal to each data line Data corresponding to all subpixels; and reading, by each detection line Sense, a threshold voltage detection signal of each subpixel 10 in this row.

In this step, for each subpixel 10 of the subpixels 10<*n*> (referred to subpixels 10<*n*> to be detected) in this row, its corresponding gate line G2 is ON. Accordingly, the switching transistor T1 is ON. Then a preset signal is provided to the data line Data, and the drive transistor T3 is ON. Consequently, the first voltage terminal VDD provides an electrical signal to the light emitting element 11. Specifically, the first voltage terminal VDD is connected with the second electrode S of the drive transistor T3 and may charge the storage capacity Cst (that is, the second electrode S of the drive transistor T3). Thus, the voltage of the second electrode S of the drive transistor T3 gradually increases up to the voltage of the first voltage terminal VDD. The voltage of the second electrode S of the drive transistor T3 is gradually getting close to the voltage of the gate G because the voltage of the gate G of the drive transistor T3 (as decided by a first preset signal provided by the data line Data). The detection line Sense may read the voltage variation of the second electrode S of the subpixel 10.

Since the gate line G1 of subpixels in other rows of this group (for example, subpixel 10<*n*+1>) is OFF, the drive transistors T3 of these subpixels are OFF and these subpixels do not affect the detection of the subpixels 10<*n*> to be detected by the detection line Sense.

S12: determining, based on the threshold voltage detection signal of each subpixel 10 in this row, the threshold voltage of the drive transistor T3 of each subpixel 10.

When voltage difference between the gate G of the drive transistor T3 and the second electrode S is smaller than or equal to the current threshold voltage of the drive transistor T3, the drive transistor T3 is changed to OFF. Accordingly, the first voltage terminal VDD is disconnected with the drive transistor T3, and the voltage of the second electrode S does not vary. When the voltage read by the detection line Sense does not vary, the threshold voltage detection signal is received to determine the actual threshold voltage of the subpixel 10.

Specifically, the threshold voltage is the threshold voltage of drive transistor T3 of the subpixel 10. When the drive transistor T3 is used too long, the threshold voltage of the drive transistor T3 will vary, and therefore causing incorrect display of the light emitting 11.

Figure 4:
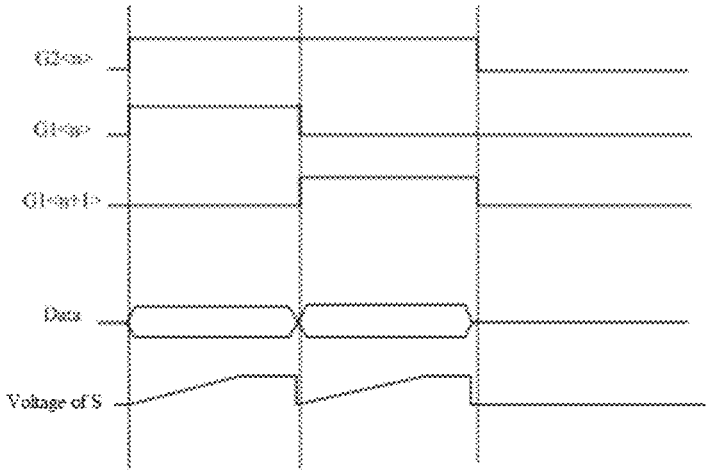
FIG. 4 is a time chart for detecting a threshold voltage of the OLED display device illustrated in FIG. 2.

In an example, in the process of detecting the drive transistors T3 of subpixels row by row comprises detecting, continuously, threshold voltages of subpixels 10 in rows of the same group, as illustrated in FIG. 4.

For all subpixels 10 in all rows, the testing will first test all subpixels in one group, and then test all subpixels in another group. That is, after all subpixels 10 corresponding to one control line G2 are tested, subpixels 10 corresponding to another control line G2 are tested.

Therefore, it is needed to provide a control line G2 with a conduction signal only once, while it is also needed to provide, in turn, a conduction signal to each gate G1 corresponding to subpixels in the same group.

For example, subpixels 10 in row 1 and row 2 are set in group 1, subpixels 10 in row 3 and row 4 are set in group 2, subpixels 10 in row 5 and row 6 are set in group 3. Accordingly, row 1 and row 2 are connected with a control line G2, row 3 and row 4 are connected with another control line G2, row 5 and row 6 are connected with another control line G2. The following subpixels 10 and rows repeat in the same manner. In the step of detecting the threshold voltage, if row 1 is detected first, then row 2 is the next row that to be detected; if row 3 is detected first, then row 4 is the next row that to be detected.

Additionally, subpixels 10 in row 1, row 2 and row 3 are set in group 1, subpixels 10 in row 4, row 5 and row 6 are set in group 2, and subpixels 10 in row 7, row 8 and row 9 are set in group 3. Accordingly, row 1, row 2 and row 3 are connected with a control line G2, row 4, row 5, and row 6 are connected with another control line G2, and row 7, row 8, and row 9 are connected with another control line G2. The following subpixels 10 and rows repeat in the same manner. In the step of detecting the threshold voltage, if row 1 is detected first, then row 2 or row 3 is the next row that to be detected; if row 4 is detected first, then row 5 or row 6 is the next row that to be detected.

In an example, the method for driving the OLED display device comprises:

S21: receiving a device shutdown signal;

S22: detecting, sequentially, threshold voltages for subpixels 10 in each row;

S23: shutting down the device.

Thus, the above detection of the threshold voltage is conducted before shutting down the OLED display device.

Since the threshold voltage of the drive transistor T3 may have significant variation after a long time, it is needed to detect the real-time threshold voltage during normal display process. Furthermore, a user will not watch screen after shutting down the device. Accordingly, all subpixels 10 may be detected every time before shutting down the device, and therefore ensuring normal display when the user is using the device.

In an example, the threshold voltage of the drive transistor T3 may be detected between two frames or may be detected periodically.

Furthermore, the step of detecting each subpixel in a row, or performing detection for the subpixels in a row, further comprises detecting mobilities K of the subpixels in the row, as illustrated in FIG. 5*a*. The step of detecting mobilities K of the subpixels in the row comprises:

S31: providing conduction signals for gate lines corresponding to the subpixel group to which the subpixels of the row belong, providing shutdown signals to other gate lines, and providing a reset signal to each data line and detection line.

This period is a reset period during which the gate lines G1 corresponding to subpixels 10 in all the rows that belong to the group of the subpixels to be determined keep all the switching transistors T1 of the group ON, so that the date lines Date provide reset signals to the gates G of the drive transistors T3. Meanwhile, the detection lines Sense provide reset signals to the second electrodes S of the drive transistors T3. The remaining signals, such as, display signals, of the subpixels 10 are cleared, and the subpixels 10 in the row enter into a determined reset status.

S32: providing a conduction signal to the gate line G1 corresponding to the subpixels 10 of this row, providing other gate lines G1 (e.g. G1<*n*+1>) with shutdown signals, providing a second preset signal to each data line Data so as to keep the drive transistors T3 of the subpixels 10 in the row ON, and charging, by the drive transistors T3 of the subpixels 10 in this row, the storage capacitors Cst of the subpixels 10 in the row.

This period is a charging period during which the conduction signal is only provided to the gate line G1 of the subpixels 10 to be determined. That is, only the switching transistors T1 of the subpixels 10 in the row to be detected are ON. The data line Data provides a second preset signal to the gate G of the drive transistors T3 of the subpixels 10 to be determined. The drive transistors T3 in the row are ON. The first voltage terminal VDD charges the storage capacitors Cst (that is, the second electrodes S of the drive transistors T3) of the subpixels 10 to be detected.

S33: providing shutdown signals to all the gate lines G1, and reading, by each detection line Sense, a mobility detection signal of each subpixel 10 in the row.

This period is a reading period during which, as illustrated in FIG. 5*b*, the first voltage terminal VDD charges the second electrode of the drive transistor T3, and thereby the voltage of the second electrode S gradually equals the voltage of the first voltage terminal VDD. The variation rate of the voltage of the second electrode S shows the conduction ability (that is, the mobility) of the drive transistor T3. As the control line G2 of the subpixels 10 to be detected receives the conduction signal, the detection line Sense may read the voltage variation rate of the voltage of the second electrode S of the drive transistor T3, that is, obtaining the mobility detection signal.

In contrast to the threshold voltage, the shutdown signal is provided to all gate lines G1. Accordingly, all switching transistors T1 are OFF, the gate G of the drive transistor T3 cannot discharge, and the voltage difference between the drive transistor T3 and the second electrode S keeps constant (that is, the voltage variation will keep smaller than the threshold voltage Vth). Therefore, discharging is conducted until the voltage of the second electrode S equals the voltage of the first voltage terminal VDD, and thus extending the detection time and improving detection accuracy.

In FIG. 5*b*, the raised area of the curve corresponding to the voltage of S in row n+1 is caused by error in actual operation.

S34: determining, according to the mobility detection signal of each subpixel 10 in the row, the mobility of the drive transistor T3 of each subpixel 10 in the row.

This period is a determining period during which the mobility of the drive transistor T3 of each subpixel 10 in the row is determined according to the received mobility detection signal.

Specifically, the mobility refers to the mobility of the drive transistor T3 of the subpixel 10. When the drive transistor T3 is used too long, the mobility of the drive transistor T3 will vary, and therefore causing incorrect display of the light emitting 11.

In an example, the mobility of the drive transistor T3 of the subpixels in the row is detected in each frame.

That is, the mobility of the drive transistor T3 is detected during the normal display, and one row of subpixels 10 is detected in each frame. Because the mobility of the drive transistor T3 is related to external factors, such as temperature, the mobility of the drive transistor T3 varies in real-time based on the actual display. Thus, in an example, the detection of the mobility of the drive transistor T3 may be real-time detection. And because the detection time for subpixels in one row is short, it is not recognizable for users' eyes when the subpixels in one row are detected in each frame.

Under the premise that normal display is not affected, the mobility of the drive transistor T3 of the subpixel 10 may be detected during the normal display.

In an example, as illustrated in FIG. 6, each frame comprises a display period for writing display signals to subpixels of each row and a keep period (or a detecting period) that is after the display period. During the keep period, the mobility is determined for each subpixel of each row. And after reading, by each detection line Sense, the mobility detection signal of each subpixel 10 in the row, the method further comprises:

S35: providing, in turn, or row by row, conduction signals to gate lines G1 corresponding to subpixels 10 in all rows of a subpixel group to which the subpixels of the row belong, and when providing a conduction signal to a gate line G1, providing, to each data line Data, a display signal of each subpixel 10 in the row corresponding to the gate line G1 in the frame.

Each frame comprises a display period and a keep period. The light emitting element 11 displays normally during the display period. During the keep period, the mobility of subpixels 10 in one row is first detected, and then display signals are provided to all the subpixels in the group that the subpixels in this row belong to, so that the subpixels of this group may continue displaying normally.

Specifically, the display signal may be a display signal that is not modified based on the mobility, and may be a display signal that is modified based on the mobility.

There are many ways to compensate each subpixel after detection. For example, the display signal provided by the date line Data is varied, or the voltage of the light emitting element 11 is directly compensated by the detection line Sense.

Various embodiments and/or examples are disclosed to provide exemplary and explanatory information to enable a person of ordinary skill in the art to put the disclosure into practice. Features or components disclosed with reference to one embodiment or example are also applicable to all embodiments or examples unless specifically indicated otherwise.

Although the disclosure is described in combination with specific embodiments, it is to be understood by the person skilled in the art that many changes and modifications may be made and equivalent replacements may be made to the components without departing from a scope of the disclosure. Embodiments may be practiced in other specific forms. The described embodiments are to be considered in all respects only as illustrative and not restrictive.

What is claimed is:

1. An organic light emitting diode (OLED) display device, comprising:

a plurality of subpixels that are arranged in an array having a plurality of rows and a plurality of columns, wherein at least one of the subpixels comprises a control transistor, a light emitting element, and a drive transistor for driving the light emitting element;

a plurality of detection lines, wherein at least one of the detection lines is electrically connected with the control transistors of subpixels in a same column, for detecting an electrical property of the drive transistors of subpixels in the same column through respective control transistors; and a plurality of group detection control lines, wherein at least one of the group detection control lines is electrically connected with control transistors of a subpixel group, the subpixel group comprises subpixels in a first row, subpixels in a second row and subpixels in a third row, and the at least one of the group detection control lines is further electrically connected with control transistors of the subpixels in the third row.

2. The OLED display device of claim 1, wherein the subpixels in the first row and the subpixels in the second row are electrically connected to a single one of the group detection control lines.

3. The OLED display device of claim 2, wherein each of the subpixels further comprises:

a switching transistor having a gate electrically connected with a gate line, a first electrode electrically connected with a data line, and a second electrode electrically connected to the drive transistor of the subpixel.

4. The OLED display device of claim 1, wherein each of the subpixels further comprises:

a switching transistor having a gate electrically connected with a gate line, a first electrode electrically connected with a data line, and a second electrode electrically connected to the drive transistor of the subpixel.

5. The OLED display device of claim 4, wherein the gate line is electrically connected with each of the subpixels in a same row; and the data line is electrically connected with each of the subpixels in a same column.

6. The OLED display device of claim 5, wherein the drive transistor has a gate electrically connected with the second electrode of the switching transistor, a first electrode electrically connected with a first voltage terminal, and a second electrode electrically connected with the light emitting element.

7. The OLED display device of claim 4, wherein the drive transistor has a gate electrically connected with the second electrode of the switching transistor, a first electrode electrically connected with a first voltage terminal, and a second electrode electrically connected with the light emitting element.

8. The OLED display device of claim 7, wherein each of the subpixels further comprises a storage capacitor having a first terminal connected with the second electrode of the switching transistor, and a second terminal connected with the second electrode of the drive transistor.

9. The OLED display device of claim 1, wherein the first row and the second row are adjacent rows.

10. The OLED display device of claim 1, wherein the first, second and third rows are three adjacent rows.

11. The OLED display device of claim 10, wherein the gate line is electrically connected with each of the subpixels in a same row; and the data line is electrically connected with each of the subpixels in a same column.

12. The OLED display device of claim 10, wherein the drive transistor has a gate electrically connected with the second electrode of the switching transistor, a first electrode electrically connected with a first voltage terminal, and a second electrode electrically connected with the light emitting element.

13. The OLED display device of claim 1, wherein each of the control transistors of the subpixel group comprises:

a gate electrically connected with the group detection control line;

a first electrode electrically connected with the detection line of a corresponding column; and a second electrode electrically connected with the drive transistor and the light emitting element of the corresponding subpixel.

14. A method for driving an organic light emitting diode (OLED) display device, wherein the OLED display device comprises:

a plurality of subpixels that are arranged in an array having a plurality of rows and a plurality of columns, wherein at least one of the subpixels comprises a control transistor, a light emitting element, and a drive transistor for driving the light emitting element;

a plurality of detection lines, wherein at least one of the detection lines is electrically connected with the control transistors of subpixels in a same column, for detecting an electrical property of the drive transistors of subpixels in the same column through respective control transistors; and a plurality of group detection control lines, wherein at least one of the group detection control lines is electrically connected with control transistors of a subpixel group, the subpixel group comprises subpixels in a first row, subpixels in a second row and subpixels in a third row, and the at least one of the group detection control lines is further electrically connected with control transistors of the subpixels in the third row;

wherein the method comprises:

performing detection for subpixels in a row;

wherein performing detection for the subpixels in the row comprises: providing a conduction signal to a corresponding group detection control line; and providing OFF signals to other group detection control lines, so that the detection lines detect the drive transistors of the subpixels in the row.

15. The method of claim 14, wherein performing detection for the subpixels in the row further comprises detecting a threshold voltage for each subpixel in the row, and wherein detecting the threshold voltage for each subpixel in the row comprises:

providing a conduction signal to a gate line corresponding to the subpixels in the row;

providing OFF signals to gate lines corresponding to subpixels in other rows;

providing a first preset signal to each data line corresponding to all subpixels;

reading, by each detection line, a threshold voltage detection signal of each subpixel in the row; and determining, based on the threshold voltage detection signal, the threshold voltage of the drive transistor of each subpixel.

16. The method of claim 15, further comprising:

receiving a device shutdown signal;

detecting, sequentially, threshold voltages for subpixels in each row; and shutting down the OLED display device.

17. The method of claim 16, wherein detecting, sequentially, the threshold voltages for subpixels in each row comprises: detecting threshold voltages for subpixels in all rows of a same subpixel group.

18. The method of claim 14, wherein performing detection for the subpixels in the row further comprises detecting mobilities for the subpixels in the row, and detecting mobilities for the subpixels in the row comprises:

providing conduction signals for gate lines corresponding to the subpixel group to which the subpixels of the row belong, providing OFF signals to other gate lines, and providing a reset signal to each data line and detection line;

providing conduction signals to a gate line corresponding to the subpixels in the row, providing other gate lines with OFF signals, providing a second preset signal to each data line so as to keep the drive transistors of the subpixels in the row ON, and charging, by the drive transistors of the subpixels in the row, storage capacitors of the subpixels in the row;

providing OFF signals to all gate lines, and reading, by each detection line, a mobility detection signal of each subpixel in the row; and determining, according to the mobility detection signal of each subpixel in the row, a mobility of the drive transistor of each subpixel in the row.

19. The method of claim 18, further comprising: detecting, in each frame, mobilities of the drive transistors of the subpixels in the row.

20. The method of claim 19, wherein each frame comprises a display period that writes display signals into subpixels in each row, and a keep period, that is after the display period, during which the mobilities for subpixels in the row are detected; and after reading, by each detection line, the mobility detection signal of each subpixel in the row, the method further comprises:

providing, in turn, conduction signals to gate lines corresponding to subpixels in all rows of a subpixel group to which the subpixels of the row belong; and when providing a conduction signal to a gate line, providing, to each data line, a display signal of each subpixel in the row corresponding to the gate line in the frame.

* * * * *